US005186920A

United States Patent [19]

Heng et al.

[11] Patent Number: 5,186,920

[45] Date of Patent: Feb. 16, 1993

[54] RECOVERING $TiO_2$ CONCENTRATES FROM $TiO_2$-CONTAINING SUBSTANCES

[75] Inventors: Rudolf Heng, Oberursel; Walter Koch, Mühlheim; Ali-Naghi Beyzavi, Frankfurt am Main, all of Fed. Rep. of Germany

[73] Assignee: Metallgesellschaft Aktiengesellschaft, Frankfurt am Main, Fed. Rep. of Germany

[21] Appl. No.: 795,292

[22] Filed: Nov. 19, 1991

Related U.S. Application Data

[63] Continuation of Ser. No. 555,247, Jul. 19, 1990, abandoned.

[30] Foreign Application Priority Data

Jul. 27, 1989 [DE] Fed. Rep. of Germany ..... 3924796

[51] Int. Cl.[5] ..... C01G 23/047

[52] U.S. Cl. ..... 423/610; 423/82; 423/83; 423/85; 423/86; 423/151; 423/594

[58] Field of Search ..... 423/610, 612, 82, 83, 423/84, 86, 85, 69, 151, 138, 594

[56] References Cited

U.S. PATENT DOCUMENTS

| | | | |
|---|---|---|---|
| 1,831,852 | 11/1931 | Farup | 423/84 |
| 3,112,178 | 11/1963 | Judd | 423/80 |
| 3,457,037 | 6/1969 | Aramendia et al. | 423/86 |
| 3,765,868 | 11/1973 | Moklebust | 75/10.61 |
| 3,816,099 | 6/1974 | Stewart et al. | 423/84 |
| 4,085,190 | 4/1978 | Shiah | 423/80 |
| 4,089,675 | 5/1978 | Preston et al. | 423/82 |
| 4,098,868 | 7/1978 | Tolley | 423/83 |
| 4,119,696 | 10/1978 | Tolley | 423/82 |
| 4,172,878 | 10/1979 | Tolley | 423/83 |
| 4,197,276 | 8/1980 | Tolley et al. | 423/85 |
| 4,199,552 | 4/1981 | Rado | 423/83 |
| 4,288,416 | 9/1981 | Davis et al. | 423/82 |

FOREIGN PATENT DOCUMENTS

| | | |
|---|---|---|
| 4622734 | 6/1971 | Japan . |
| SU1125194 | 11/1984 | U.S.S.R. . |
| 795164 | 5/1958 | United Kingdom . |
| 980864 | 3/1971 | United Kingdom . |

*Primary Examiner*—Theodore Morris
*Assistant Examiner*—Edward Squillante
*Attorney, Agent, or Firm*—Herbert Dubno; Jonathan Myers

[57] ABSTRACT

The iron content of the $TiO_2$-containing precursor is subjected to a direct reduction to effect a metallization of at least 90%. The reduced product is separated into magnetic and nonmagnetic fractions by magnetic separation. To oxidize the metallic iron, the magnetic fraction is subjected to an oxidation in an acid medium with agitation at a pH value below 2, under a pressure of 12 to 24 bars, and at a temperature from 150° to 210° C. with a supply of an oxygen-containing gas that contains at least 90% oxygen. When the suspension has been pressure-relieved, the hematite which has been formed is separated from the $TiO_2$ concentrate.

12 Claims, No Drawings

RECOVERING $TiO_2$ CONCENTRATES FROM $TiO_2$-CONTAINING SUBSTANCES

This is a continuation of co-pending application Ser. No. 07/555,247 filed on Jul. 19, 1990.

FIELD OF THE INVENTION

Our present invention relates to a process for recovering a $TiO_2$ concentrate from $TiO_2$-containing precursors by a direct reduction of the iron content of the precursors to metallic iron, a magnetic separation of the reduced product into magnetic and nonmagnetic fractions, an oxidation of the metallic iron of the magnetic fraction in an acid aqueous medium with agitation of the suspension and a supply of oxygen-containing gas into the suspension at an elevated temperature and under a superatmospheric pressure, and a subsequent separation of the iron oxides from the $TiO_2$ concentrate.

BACKGROUND OF THE INVENTION

Synthetic rutile is recovered as a $TiO_2$ concentrate from $TiO_2$-containing substances, such as ilmentite and pseudorutile.

British Patent Specification 980,864 discloses a process in which ilmenite is reduced at temperatures from 1000° to 1150° C. with an addition of carbon, the reduced ore is separated by sieving and magnetic separation from the gangue and surplus reducing agent, and the metallic iron is oxidized by an oxidation effected in an acid aqueous medium having a pH value of at least 4 but below 7 and is thus liberated from the reduced ilmenite.

The oxidation is effected with agitation and with a supply of oxygen-containing gases into the suspension, either under atmospheric pressure and at a temperature in the range of 60 to 80° C., or under a pressure of about 7 bars and at a temperature in the range from 150° to 170° C.

The oxygen-containing gas which is employed preferably consists of a mixture of air and $CO_2$. Mixtures of oxygen and $CO_2$, $SO_2$ and $NO_2$ are also mentioned as well as mixtures of $SO_2$ and/or $NO_2$ with air, oxygen and $CO_2$ individually or in combination. An oxidation under a pressure of 7 bars and with a supply of air or of mixtures of oxygen with $CO_2$, $SO_2$ or $NO_2$ will result in $TiO_2$ concentrates having poor properties.

In the practice of that process the oxidation is effected under atmospheric pressure and with a supply of air and an addition of $NH_4Cl$. As that oxidation requires a long reaction time, that stage must be effected discontinuously and is highly expensive. The composition of the iron oxides cannot be controlled. If the ilmenite contains manganese, that process will require an after-leaching with sulfuric acid in a separate stage. The resulting acid filtrate must be subjected to a sewage treatment.

OBJECTS OF THE INVENTION

It is an object of the invention to avoid these disadvantages and to permit a fast oxidation with high yield and a production of a high-grade synthetic rutile.

Another object is to provide an improved method of recovering $TiO_2$ concentrates whereby prior art drawbacks are obviated.

DESCRIPTION OF THE INVENTION

That object is accomplished in accordance with the invention in that the iron content of the $TiO_2$-containing precursors is reduced to effect a metallization of at least 90% (i.e. a conversion of the iron content, usually iron compounds to metallic iron of at least 90%), the oxidation of the separated magnetic fraction is effected in a sulfuric acid or hydrochloric acid medium at a pH value below 2, under a pressure of 12 to 24 bars, and at a temperature from 150° to 210° C. and with a supply of an oxygen-containing gas which contains at least 90% oxygen and is supplied at least at the rate which is stoichiometrically required to form hematite, and the resulting hematite is separated from the $TiO_2$ concentrate which is contained in the suspension after the latter has been pressure-relieved.

The direct reduction of the iron content, i.e. a reduction in a solid state below the melting point of the charge, may be effected in a rotary kiln, an orthodox fluidized bed or a circulating fluidized bed. The reducing agents employed may consist of solid carbon, or of a gas or of combinations thereof. The direct reduction is preferably carried out in a rotary kiln in a countercurrent operation, in which coal is used as a reducing agent.

If the $TiO_2$ precursors which are employed contain manganese, sulfur or sulfur-containing substances will be added so that the manganese content is transformed to manganese sulfide, which is leached in the acid medium employed to effect the succeeding oxidation.

To prevent a reoxidation of metallic iron, the material discharged from the rotary kiln is cooled under conditions under which metallic iron will not be oxidized.

A magnetic separation is subsequently performed. The magnetic fraction contains metallic iron and $TiO_2$. The nonmagnetic fraction consists of a surplus-reducing agent, gangue and coal ash. The surplus-reducing agent may be recycled to the rotary kiln. The exhaust gas from the rotary kiln is preferably afterburnt and is supplied to a gas purifier.

The magnetic fraction is charged together with water into a tank. A suspension is produced by stirring and is withdrawn at a controlled rate from the tank and supplied to the autoclave. Acid at the rate required to adjust a pH value below 2 is then directly pumped into the autoclave when the same has been closed and is being supplied with oxygen. The $O_2$ partial pressure in the autoclave will prevent a formation of $H_2$ and/or $H_2S$. The autoclave may be equipped with stirrers or may consist of a tumbling autoclave.

The required residence time of the suspension in the autoclave is empirically determined for each material and generally amounts to 10 to 30 minutes.

The oxygen-containing gas which is employed consists of commercially pure oxygen which contains at least 90% and preferably 94 to 96% oxygen.

The total pressure in the autoclave is composed of the water vapor pressure corresponding to the temperature and of the pressure of the oxygen-containing gasses which are supplied. The oxygen-containing gas is supplied at a rate which is at least as high as the rate which is stoichiometrically required to oxidize the metallic iron to hematite.

In batch operation, oxygen is used only in a small surplus. Whereas a larger surplus of oxygen would not be disturbing, it would involve a corresponding loss of oxygen. But the autoclave is preferably operated continuously because that mode of operation is more economical.

In continuous operation oxygen is always supplied in a large surplus related to the flow rate of the suspension. But that surplus oxygen is not consumed so that it will not be lost.

The quality of the synthetic rutile and the yield are virtually the same in case of an oxidation under pressure in a sulfuric acid or hydrochloric acid medium. But the use of a sulfuric acid medium is preferred because it involves fewer corrosion problems. The suspension may contain up to 60 g sulfuric acid per liter.

The suspension which has been discharged from the autoclave is pressure-relieved in a plurality of stages. The pressure is preferably relieved in two stages. A pressure relief to about 6 bars is effected in the first stage and to about 1.5 bars in the second. The pressure-relieved suspension is separated into $TiO_2$ concentrate and hematite by a multistage hydrocyclone treatment.

The $TiO_2$ concentrate is filtered, e.g. on a belt filter and is washed with water and is subsequently dried and delivered as synthetic rutile. The residual suspension, which contains hematite, is also subjected to a solid-liquid separation. The moist residue is dumped or is processed further.

In accordance with a preferred feature, the iron content of the precursors is reduced to effect a metallization about 93%. That metallization results in a product of high purity.

In accordance with a further feature the magnetic fraction is continuously oxidized under pressure. If the autoclave is provided with stirrers, the autoclave is preferably divided on the liquid side into a plurality of compartments by partitions. A stirrer and lines for supplying the oxygen-containing gas into the suspension are provided in each compartment. The suspension is supplied at one end of the autoclave into the first compartment and flows from compartment to compartment over the partitions and is withdrawn from the last compartment at the other end of the autoclave. A continuous oxidation under pressure will result in considerable savings relative to a batch oxidation under pressure.

In accordance with a preferred feature, the suspension has a pH value from 0.9 to 1.2 during the oxidation under pressure. A pH value in that range will result in particularly good operating conditions.

In accordance with a preferred feature, the suspension contains 5 to 30 g/l sulfuric acid and 15 to 35% by weight solids. Good results will be produced in that case.

In accordance with a preferred feature, the suspension contains 8 to 12 g/l sulfuric acid and 20 to 27% by weight solids. Particularly good results will be produced by an operation under such conditions.

In accordance with a preferred feature, the oxidation under pressure is effected under a pressure of 13 to 18 bars. Particularly good results will be obtained in that range.

In accordance with a preferred feature, the oxidation under pressure is effected under an $O_2$ partial pressure which is 3 to 6 bars higher than the water vapor pressure that corresponds to the prevailing temperature. This will result in a highly effective liberation of the oxidized iron content form the reduced solids. That $O_2$ partial pressure is constantly maintained particularly in continuous operation. In a batch operation, the $O_2$ partial pressure will be much lower at the end of the treatment.

In accordance with a preferred feature, the oxidation under pressure is effected under an $O_2$ partial pressure which is 4 to 5 bars above the water vapor pressure that corresponds to the prevailing temperature. This will result in a highly effective liberation of oxidized iron content from the reduced solids. That $O_2$ partial pressure is constantly maintained particularly in continuous operation. In a batch operation, the $O_2$ partial pressure will be much lower at the end of the treatment.

In accordance with a preferred feature, the oxidation under pressure is effected at a temperature form 170° to 190° C. Particularly good results will be produced at that temperature.

In accordance with a preferred feature, the filtrates obtained by the separation of the hematite and the $TiO_2$ concentrate from the pressure-relieved suspension are recycled for the preparation of the suspension which contains the magnetic fraction. The evaporation of water during the pressure relief may be compensated by the washing waters. As a result, there will be no waste water or waste waters will be obtained only at low rates when enriched impurities must be withdrawn from the circulation.

SPECIFIC EXAMPLE 1 kg ilmenite was reduced by means of 0.6 kg coal, which contained about 1% sulfur, and by means of 10 kg sulfur in a Salvis furnace at 1100° C., below the melting point. The reduced material was then cooled in a nitrogen stream and was sieved at 0.7 mm. The coarses consisted of surplus coal. The undersize was subjected to magnetic separation. The magnetic produce can be described as reduced ilmenite and had the following chemical analysis:

| | |
|---|---|
| Ti as $TiO_2$ | 66.4 by weight |
| Fe total | 31.5 |
| Fe metallic | 30.3 |
| Mn | 1.0 |
| S | 0.58 |
| Metallization | 96.0% |

The reduced ilmenite had a particle size range from 0.3 to 0.032, which is virtually the same particle size range as that of the ilmenite charged into the furnace.

A suspension of 450 $cm^3$ water and the reduced ilmenite was prepared and was supplied to a stirrable autoclave. 12.2 liters of pure oxygen under a pressure of 10 bars and 50 $cm^3$ of dilute sulfuric acid (5 g $H_2SO_4$), corresponding to a pH value of about 1, were supplied to the closed autoclave. The suspension was heated to 80° C. by external heat. Then the supply of external heat was discontinued and the stirrer was operated at its full speed so that the supply of oxygen to the suspension was initiated.

As soon as the aeration was initiated, the reaction started; this was indicated by a strong temperature rise. The maximum temperature of 207° C. was reached after 3 minutes. During that time the $O_2$ partial pressure was always kept 5 bars above the water vapor pressure corresponding to the prevailing temperature.

The water vapor pressure amounted to 18 bars so that the total pressure was 23 bars. After a total time of 15 minutes, the autoclave was cooled with water to a temperature below 100° C. After the cooling, the suspension was filtered off and the filter cake was slurried in water and by repeated decanting was separated into synthetic rutile and hematite.

The chemical analyses were as follows:

| The chemical analyses were as follows: | | |
|---|---|---|
| | Synthetic rutile | Hematite |
| $TiO_2$ | 98.7% by weight | 1.8% by weight |
| Fe total | 1.1 | 66.8 |
| Fe metallic | 0.16 | <0.05 |
| Mn | 0.7 | <0.05 |
| S total | 0.08 | 0.9 |

The advantages afforded by the invention reside in that the oxidation is effected within a very short time and with a very high conversion so that the plant is operated at a very high specific output. Owing to the relatively short agitation time during the oxidation, the particle size of the charged material is substantially preserved and there is no strong disintegration. Besides, the oxidation may be effected continuously. The oxidation under pressure eliminates the need for an acid after-leaching of the rutile in a separate stage. Waste water can be avoided or minimized.

We claim:

1. A method of recovering a $TiO_2$ concentrate from a $TiO_2$-containing and iron-compound-containing composition, which comprises the steps of:

(a) directly reducing iron compounds in said composition to metallic iron to effect a metallization thereof of at least 90% and produce a further composition containing a magnetic fraction with $TiO_2$ and metallic iron and a nonmagnetic fraction with residual reducing agent and cooling the metallic iron under conditions under which metallic iron will not be oxidized to prevent reoxidation of the metallic iron;

(b) magnetically separating said fractions in said further composition and recovering said magnetic fraction from said further composition;

(c) oxidizing the recovered magnetic fraction by forming a suspension thereof in a sulfuric acid or hydrochloric acid medium at a pH below 2 under a pressure of 12 to 24 bar and at a temperature of 150° to 210° C. and by supplying an oxygen-containing gas to said medium which contains at least 90% oxygen at a rate at least equal to the rate of supply stoichiometrically required to form hematite by the iron of said magnetic fraction, thereby transforming the iron of said magnetic fraction substantially quantitatively to hematite;

(d) pressure relieving said suspension; and (e) separating hematite from a $TiO_2$ concentrate in said suspension by multistage hydrocyclone treatment, thereby separately recovering suspensions of hematite and said $TiO_2$ concentrate therefrom.

2. The method defined in claim 1 wherein the iron content of the precursors is reduced to effect a metallization above 93%.

3. The method defined in claim 1 wherein the magnetic fraction is continuously oxidized under pressure.

4. The method defined in claim 1 wherein the suspension has a pH of 0.9 to 1.2 during the oxidation under pressure.

5. The method defined in claim 1 wherein the suspension contains 5 to 30 g/l sulfuric acid and 15 to 35% by weight solids.

6. The method defined in claim 1 wherein the suspension contains 8 to 12 g/l sulfuric acid and 20 to 27% b weight solids.

7. The method defined in claim 1 wherein the oxidation under pressure is effected under a pressure of 13 to 18 bars.

8. The method defined in claim 7 wherein the oxidation under pressure is effected under an $O_2$ partial pressure which is 3 to 6 bars higher than a water vapor pressure that corresponds to the prevailing temperature.

9. The method defined in claim 8 wherein the oxidation under pressure is effected under an $O_2$ partial pressure which is 4 to 5 bars above a water vapor pressure which corresponds to the prevailing temperature.

10. The method defined in claim 9 wherein the oxidation under pressure is effected at a temperature from 170° to 190° C.

11. The method defined in claim 1 wherein the filtrates obtained by the separation of the hematite and the $TiO_2$ concentrate from the pressure-relieved suspension are recycled for the preparation of the suspension which contains the magnetic fraction.

12. The method defined in claim 1 wherein according to step (a) the cooling of the metallic iron obtained after reduction of the iron compounds contained in the composition is carried out in a nitrogen stream and is sieved at 0.7 mm.

* * * * *